United States Patent [19]

Songer et al.

[11] 4,245,834

[45] Jan. 20, 1981

[54] PRINT RECEIVING TRAY

[75] Inventors: Larry A. Songer, Schaumburg; C. Ray Cooper, Barrington, both of Ill.

[73] Assignee: AM International, Inc., Los Angeles, Calif.

[21] Appl. No.: 252

[22] Filed: Jan. 2, 1979

[51] Int. Cl.[3] ..... B65H 31/20

[52] U.S. Cl. ..... 271/213; 271/223; 211/50

[58] Field of Search ..... 271/207, 213, 224, 223, 271/208, 209, 210, 211, 220, 222; 211/50, 126; 108/152, 134

[56] References Cited

U.S. PATENT DOCUMENTS

| | | | |
|---|---|---|---|
| 382,402 | 5/1888 | Baltes | 271/223 |
| 3,912,389 | 10/1975 | Miyamoto | 271/213 |

*Primary Examiner*—Robert B. Reeves
*Assistant Examiner*—B. Bond
*Attorney, Agent, or Firm*—A. W. Karambelas; R. C. Curfiss

[57] ABSTRACT

A print receiving tray is provided for receiving and stacking in register prints of various predetermined lengths issuing from a copying machine. The tray comprises a fixed support secured to the copying machine and a movable support pivotally mounted on the fixed support. The movable support is positionable among a first, an intermediate and an extended position for conditioning the tray for receiving prints of uniform predetermined lengths at each of the positions differing from the uniform predetermined length of the prints at each of the other positions. Releasable retaining means is provided for holding the movable support in the extended position and for releasing the movable support for movement to either the intermediate or the first position. The movable support also includes register means for aligning a lead end of each print received by the receiving tray.

8 Claims, 7 Drawing Figures

PRINT RECEIVING TRAY

BACKGROUND OF THE INVENTION

Although the receiving tray of the present invention may be utilized with various types of equipment, for purposes of this disclosure it will be described as used with a diazotype copying machine for producing prints or copies of original documents to be copied. For example, such copying machines are normally used for producing white prints from drawings or the like prepared on translucent material.

In the operation of such equipment, the original to be copied is fed in superposed relation with a sensitized copy sheet into an exposure unit of the copying machine. After exposure, the original and the copy sheet are discharged from the machine, separated from each other, and the copy sheet bearing a latent image is fed through a developer unit of the machine to produce a visible image on the copy sheet. The finished print is discharged from the machine to a print receiving tray.

Conventionally, drawing or tracing material for preparing original drawings is provided in various standard sizes, and the copy sheets for making prints from the drawings are provided in sizes corresponding to the size of the drawings. In other instances, the copy material is fed from a roll supply and is cut to a size or length corresponding to the size of the original during the feeding of the copy material and the original to the exposure unit. In either case, the size of the prints varies as determined by the size of the originals being copied.

Normally, the prints exiting from the copying machine are received by a shelf or the like in a random fashion for subsequent retrieval by the machine operator. While such a shelf could be arranged to stack and register prints of a single predetermined length, it would not provide for stacking and registering the lead ends of prints of different predetermined lengths. Therefore, the receiving of prints of various lengths by the shelf results in a disarrayed stack requiring further manipulation by the machine operator in order to arrange the prints in a neat and orderly fashion and in registered alignment.

SUMMARY OF THE INVENTION

The present invention relates to a receiving tray for receiving and stacking prints of various predetermined lengths issuing from a copying machine. More specifically, the invention provides a tray for receiving and stacking prints of various predetermined lengths in an aligned and registered condition in response to the machine operator selecting one of several positions of a movable support for conditioning the receiving tray to suit the length of the prints to be run.

The invention provides a fixed support secured to the copying machine adjacent a print issuing station from which the prints are delivered to the receiving tray. The movable support is pivotally mounted on the fixed support for manual positioning to a first position, an intermediate position and an extended predetermined position for conditioning the print receiving tray for receiving prints of a uniform predetermined length at each of the positions differing from the uniform predetermined length of the prints at each of the other positions.

A releasable retaining means is provided for holding the movable support in the extended position and is actuable to release the movable support for movement to the intermediate and the first position. The movable support is also provided with a register means for aligning the lead end of each print delivered to the receiving tray in any of the selected positions of the movable support.

It is an object of the present invention to provide an improved print receiving tray for receiving and stacking prints of various uniform predetermined lengths issuing from a copying machine and delivered to the receiving tray.

Another object is to provide the receiving tray with register means for aligning the lead ends of the prints delivered to the tray.

Another object is to provide a receiving tray including a fixed and a movable support. The movable support is adapted for selective movement among a first, an intermediate and an extended predetermined position for receiving and stacking in register prints of various uniform predetermined lengths issuing from the copying machine.

Another object is to provide a receiving tray for use with a copying machine for stacking prints of various predetermined lengths without requiring the removal or addition of any extra attachments, and in which the tray can be conditioned for receiving prints of various lengths from either side of the copying machine.

A feature of the invention is to provide a receiving tray which is simple in operation and construction, and may be readily adapted to existing copying machines without requiring major modification thereto.

Other objects, features and advantages of the invention will appear hereinafter as the description proceeds.

IN THE DRAWING

DESCRIPTION OF THE PREFERRED EMBODIMENT

Figure 1:
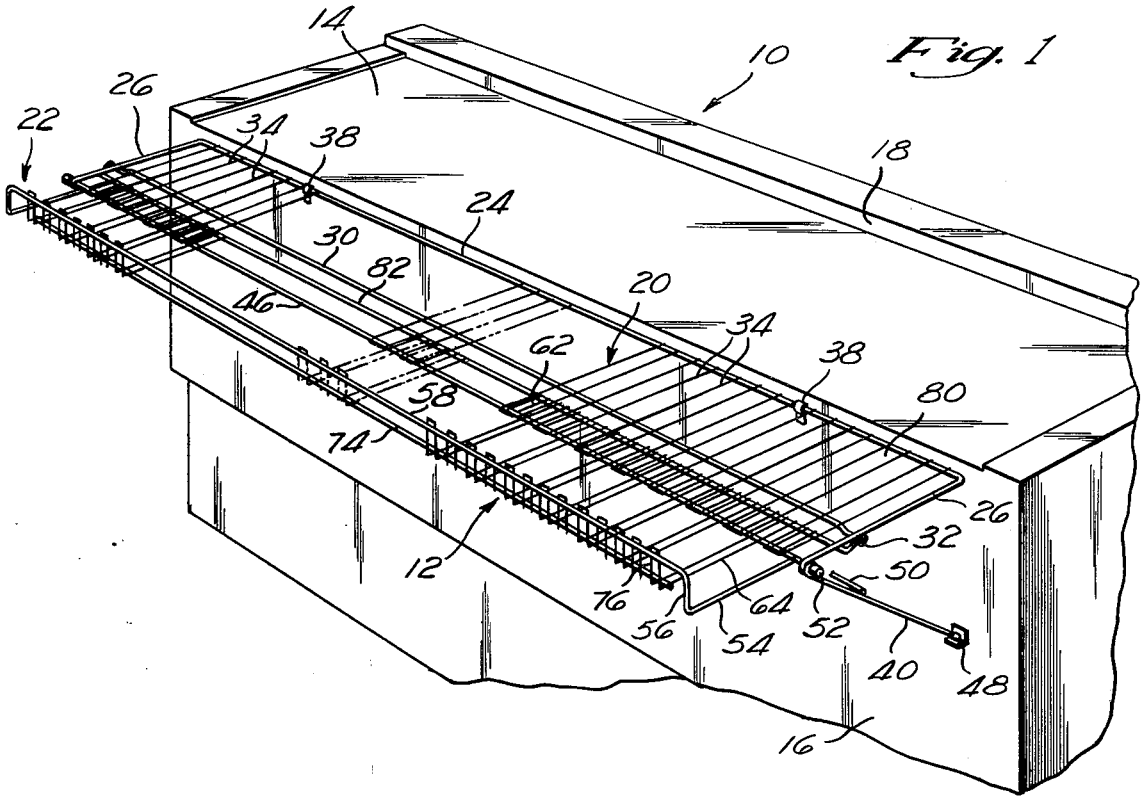
FIG. 1 is a top, right-front perspective of a print receiving tray mounted on a copying machine in accordance with the present invention, showing a movable support of the receiving tray in an extended position.

With reference to FIG. 1, there is shown a copying machine and a print receiving tray indicated generally by the reference numerals 10 and 12 respectively. The copying machine 10 comprises a top surface 14, a backwall 16 and an outlet 18 for passage of a print from a developer unit of the copying machine 10 to the print receiving tray 12. The print receiving tray is preferably made of metal rods or wires of circular cross section and comprises a fixed support and a movable support indicated generally by the reference numerals 20 and 22 respectively.

Figure 2:
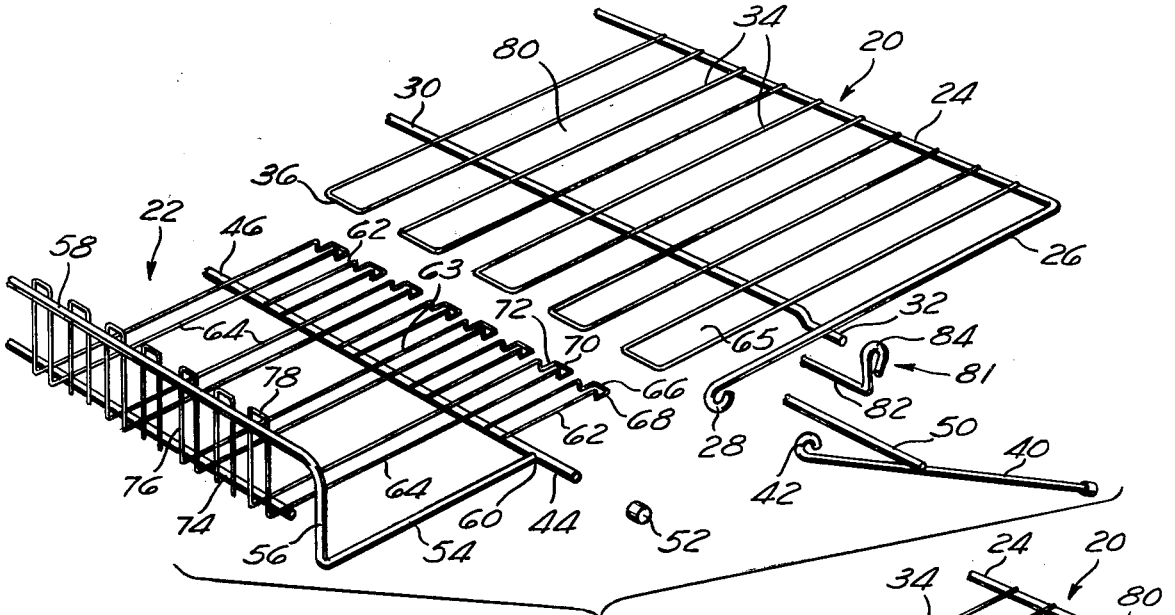
FIG. 2 is an exploded perspective view of the receiving tray partially broken away.
Figure 3:
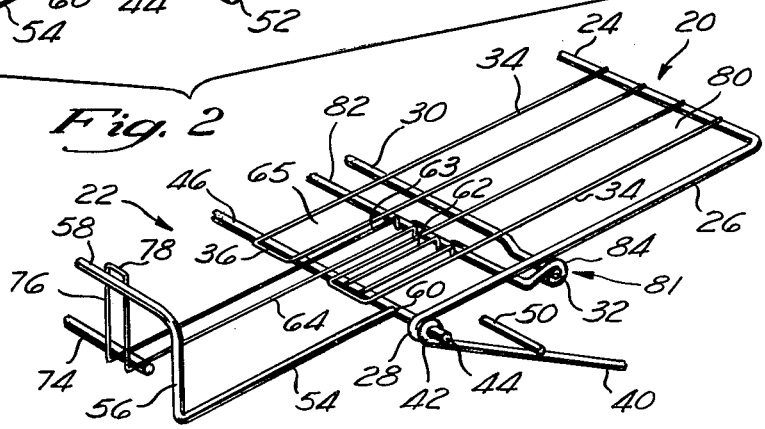
FIG. 3 is a perspective view of the receiving tray, partially broken away, showing the movable support in the extended position.

As best shown in FIGS. 1, 2 and 3, the fixed support 20 comprises a generally U-shaped frame having a straight section 24 formed at each end at a right angle to provide end members 26. Each end member 26 terminates in a loop 28 for pivotally receiving an end 44 of a support bar 46 of the movable support 22. A support rod 30 extends between the end members 26, at a position spaced from and parallel to the straight section 24, and is provided at each end with an offset 32 secured to the underside of the end members 26 and projecting slightly beyond the end members. The fixed support 20 also comprises a plurality of bail members 34 position in spaced apart relation and extending parallel with the end members 26. The bail members 34 are each secured to the upper surfaces of the straight section 24 and the support rod 30, and terminate in a closed end 36 as best shown in FIGS. 2 and 3.

The fixed support 20 is mounted on the copying machine 10 by supporting the straight section 24 in a pair of clamps 38 fastened to the backwall 16 of the copying machine. As shown in FIGS. 1, 2, 3 and 4, there is also provided a pair of brace members 40 each having a loop 42 formed at one end thereof for supporting the brace members on the ends 44 of the support bar 46 of the movable support 22. The other end of each of the brace members 40 is supported by a bracket 48 fastened to the backwall 16 of the copying machine. A tie bar 50 is secured to the brace members 40 for rigidly holding the brace members in spaced apart relation. The movable support 22 and the brace members 40 are held against endwise displacement by providing a cap 52 on each end 44 of the support rod 46.

The movable support 22 as best shown in FIGS. 1, 2 and 3 comprises a generally U-shaped frame including end members 54, vertical legs 56 and a straight section 58 connecting the upper ends of the legs 56 and extending parallel with the support bar 46. One end of each of the end members 54 is secured to the support bar as shown at 60 in FIGS. 2 and 3.

The movable support 22 is also provided with a plurality of bail members 62 and 64, see FIGS. 2 and 3, arranged in spaced apart relation and extending parallel to the end members 54. The bail members 62 and a lead portion 63 of the bail members 64 define a first register means as will be further described hereinafter. Each of the bail members 62 is secured at one end to the support bar 46 and extends outwardly therefrom in a direction towards the fixed support 20 terminating in a closed end 66 offset downwardly to provide a lip 68. Each of the portions 63 of the bail members 64 is similarly provided with a closed end 70 offset downwardly to provide a lip 72. The bail members 64 are arranged in alternate adjacent positions with the bail members 62 and are secured to the support bar 46 and a support member 74. The other end of each of the bail members 64, opposite the closed end 70, is provided with an upstanding bail member 76, defining a second register means, secured to the straight section 58 and terminating in a closed end 78 projecting slightly beyond the straight section 58. Thus, when the movable support 22 is in an extended position as shown in FIG. 3 and in full lines in FIG. 4, each of the bail members 62 is positioned within an opening 65 of a corresponding bail member 34 of the fixed support 20 and the lead portion 63 of each of the bail members 64 is positioned within a space 80 between adjacent bail members 34.

With reference to FIGS. 2 and 3, the receiving tray 12 is provided with a releasable retaining means indicated generally by the reference numeral 81 comprising a rod 82 extending parallel with the support rod 30 and including a loop 84 at each end thereof for pivotally supporting the rod 82 on the ends of the offset 32 of the support rod 30. The rod 82 is adapted for pivotal movement into coacting relation with the lips 68 and 72 of the bail members 62 and 64 respectively, for holding the movable support 22 in the extended position as will be further described hereinafter.

Figure 4:
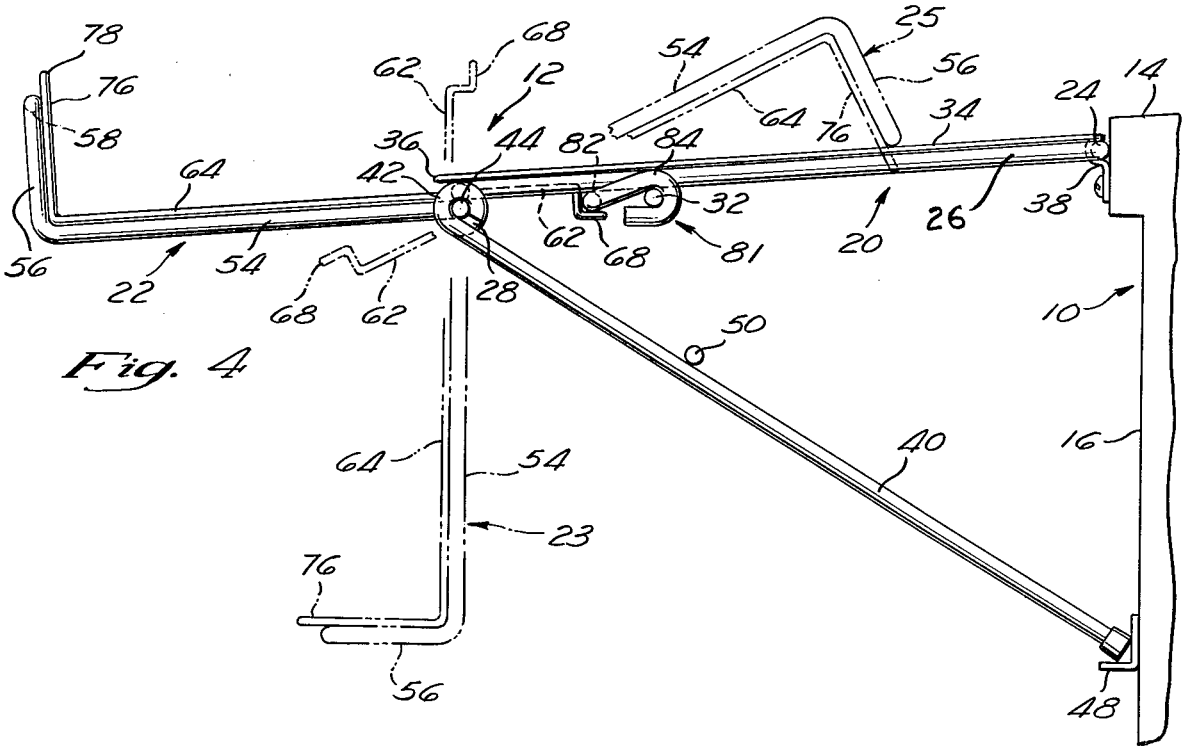
FIG. 4 is an end elevation of the receiving tray illustrating the movable support in full lines in the extended position and showing the movable support in a first and an intermediate position in phantom.
Figure 5:
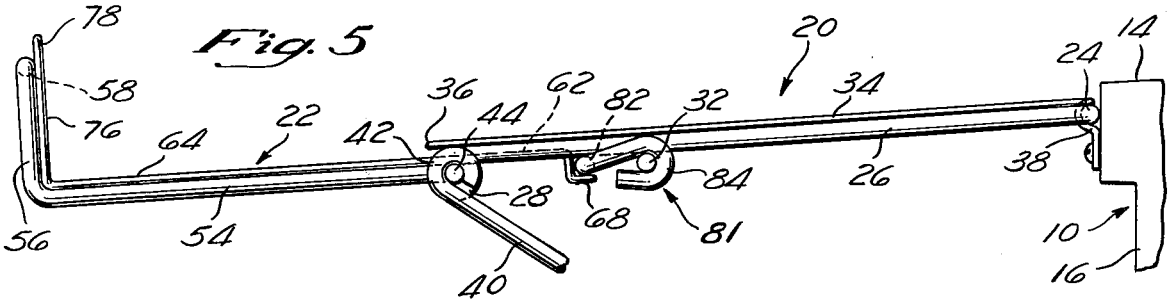
FIG. 5 is an end elevation of the receiving tray showing a releasable retaining means in an operative position for holding the movable support in the extended position.

With reference now to FIG. 4, the movable support 22 is shown in full lines in the extended position, and is shown in phantom in the intermediate position indicated by the reference numeral 23 and the first position indicated by the reference numeral 25. To position the movable support 22 from the intermediate position shown in FIG. 6 to the extended position shown in FIGS. 4 and 5, the movable support is pivoted about the ends 44 of the support bar 46, in a clockwise direction as viewed in FIGS. 4 and 6, to a position whereby the lips 68 and 72 are below and clear of the rod 82 of the releasable retaining means 81. The releasable retaining means 81 is then rotated manually in a clockwise direction from an inoperative position shown in FIGS. 6 and 7 to an operative position shown in FIG. 4 and the movable support 22 is pivoted in the opposite direction so as to position the rod 82 into holding engagement with the lips 68 and 72 as shown in FIGS. 4 and 5. In this position, the rod 82 is in contact with the undersides of the end members 26 thereby preventing further clockwise rotation of the rod 82, and the rod coacting with the lips 68 and 72 holds the movable support 22 securely in the extended position. In this position, prints issuing from the copying machine 10 are deposited in the receiving tray 12 and the lead end of each of the prints of a uniform predetermined length is aligned against the second register means comprising the bail members 76 to provide a stack of prints in a neat and orderly condition.

Figure 6:
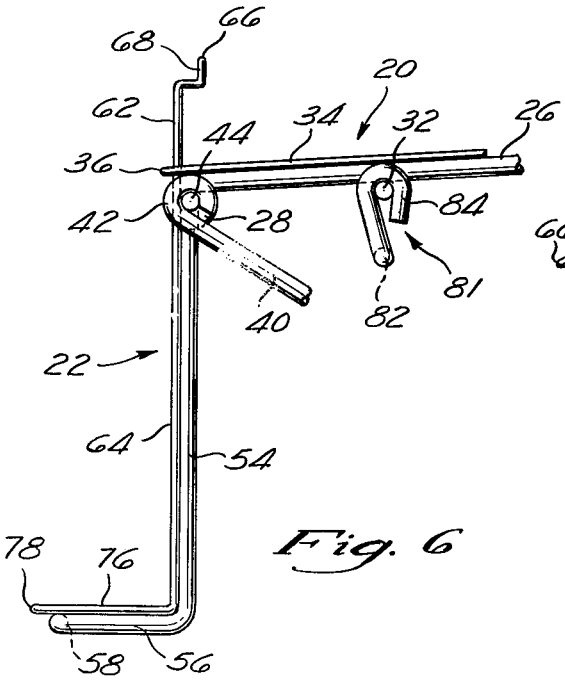
FIG. 6 is an end elevation of the receiving tray, partially broken away, showing the releasable retaining means in an inoperative position and the movable support in the intermediate position.
Figure 7:
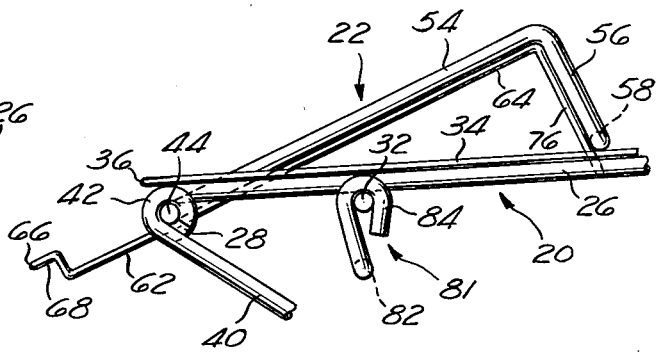
FIG. 7 is an end elevation of the receiving tray, partially broken away, showing the movable support in the first position.

To position the movable support 22 from the extended to the intermediate position 23 shown in FIGS. 4 and 6, the movable support is first pivoted in a clockwise direction about the ends 44 to a position whereby the lips 68 and 72 are clear of the rod 82, whereby the releasable retaining means 81 is caused to pivot by gravity in a counterclockwise direction to the inoperative position shown in FIGS. 6 and 7 wherein the rod 82 is out of coacting relation with the lips 68 and 72. The movable support 22 is then pivoted in a counterclockwise direction and comes to rest in a substantially vertical position defining the intermediate position as shown in FIG. 6 and in phantom at 23 in FIG. 4. During the counterclockwise motion of the movable support 22, each of the bail members 62 passes freely through the opening 65 of a corresponding bail member 34 and the lead portion 63 of each of the bail members 64 passes freely through the space 80 between adjacent bail members 34. In this position of the movable support 22, the first register means comprising the bail members 62 and the portion 63 of the bail members 64 projects upwardly above the bail members 34 of the fixed support 20 for aligning the lead end of each of the prints issuing from the copying machine 10. Thus, this intermediate position of the movable support 22 is effective to align a stack of prints of a uniform predetermined length shorter than the length of the prints delivered to the receiving tray 12 when the movable support 22 is in the extended position.

To receive and accurately stack prints of a uniform predetermined length shorter than the length of the prints delivered to the intermediate position, the movable support 22 is rotated in a clockwise direction from the position shown in FIGS. 5 and 6 to the first position shown in FIG. 7 and in phantom at 25 in FIG. 4. Positioning the movable support 22 from the extended position to the first position does not require manual actuation of the releasable retaining means 81 since the clockwise pivotal motion of the movable support 22 moves the lips 68 and 72 in a direction away from the rod 82 causing the rod to pivot by gravity in a counterclockwise direction from the operative position shown in FIG. 5 to the inoperative position shown in FIGS. 6 and 7. In the first position of the movable support 22, the closed ends 78 of the bail members 76 project downwardly through the spaces 80 between adjacent bail members 34 of the fixed support 20 and the straight section 58 rests on the upper surfaces of the bail members 34. Thus, as prints of a uniform predetermined length are delivered to the receiving tray with the movable support 22 in the first position, the lead end of each of the prints is aligned by the second register means comprising the bail members 76 of the movable support 22.

To position the movable support 22 from the first position 23 to the intermediate position, and vice versa, it is only necessary to pivot the movable support in a counterclockwise and clockwise direction respectively, as viewed in FIG. 4. However, to position the movable support 22 from the first to the extended position requires that the releasable retaining means 81 be manually rotated or actuated to the operative position so as to position the rod 82 into coacting relation with the lips 68 and 72 of the bail members 62 and 64 respectively.

From the foregoing, it will be appreciated that the present invention provides an improved print receiving tray for receiving and aligning prints of various predetermined lengths issuing from a copying machine. The receiving tray may be readily adapted to existing machines without requiring the removal or addition of extra attachments. The invention also provides for convenient and easy operation of the movable support to a selected position from either side of the copying machine to condition the receiving tray for receiving and aligning prints of a uniform predetermined length at each of the positions differing from the uniform predetermined length of the prints at each of the other positions.

What is claimed is:

1. A print receiving tray for receiving and stacking prints of various predetermined lengths issuing from a copying machine, comprising:

a fixed support mounted on the machine;

a movable support pivotally mounted on the fixed support for movement to a position selected from a plurality of predetermined positions comprising a first, an intermediate and an extended position, each said position conditioning the print receiving tray for receiving prints of a different but uniform predetermined length;

a lip means provided on the movable support; and releasable retaining means actuable between an operative position in coacting relation with the lip means for holding the movable support in one of the predetermined positions and an inoperative position out of coacting relation with the lip means for releasing the movable support for movement to any of the other predetermined positions.

2. A print receiving tray as set forth in claim 1 further comprising register means on the movable support for aligning each print received by the print receiving tray, said register means comprising:

a first bail means for aligning a lead end of each print received by the print receiving tray when the movable support is in the intermediate position; and a second bail means for aligning a lead end of each print received by the print receiving tray when the movable support is in either the first or the extended position.

3. A print receiving tray as set forth in claim 1 in which the releasable retaining means comprises a rod means pivotally mounted on the fixed support, whereby actuation of the releasable retaining means to the operative position pivots the rod means into coacting relation with the lip means for holding the movable support in said one of the predetermined positions.

4. A print receiving tray as set forth in claim 3 in which actuation of the releasable retaining means from the operative to the inoperative position pivots the rod means out of coacting relation with the lip means for releasing the movable support for movement from said one of the predetermined positions to said any of the other predetermined positions.

5. A print receiving tray as set forth in claim 3 in which the releasable retaining means is actuated from the operative to the inoperative position and the rod means is pivoted out of coacting relation with the lip means by gravity in response to movement of the movable support from the extended position to the first position.

6. A print receiving tray as set forth in claim 1 in which actuation of the releasable retaining means to the operative position holds the movable support in the extended position, and in which actuation of the releasable retaining means from the operative to the inoperative position releases the movable support for movement from the extended to the intermediate position.

7. A print receiving tray for receiving and stacking prints of various predetermined lengths issuing from a copying machine, comprising:

a fixed support mounted on the copying machine;

a movable support pivotally mounted on the fixed support for selective movement among a first, an intermediate and an extended predetermined position for conditioning the print receiving tray for receiving prints of a uniform predetermined length at each of the positions differing from the uniform predetermined length of the prints at each of the other positions;

a lip means provided on the movable support;

releasable retaining means comprising a rod means pivotally mounted on the fixed support, said releasable retaining means actuable between an operative position to pivot the rod means into coacting relation with the lip means for holding the movable support in the extended position, and an inoperative position to pivot the rod means out of coacting relation with the lip means for releasing the movable support for movement to either the first or the intermediate position; and register means on the movable support for aligning a lead end of each print delivered to the print receiving tray.

8. A print receiving tray as set forth in claim 7 in which actuation of the releasable retaining means from the operative position to the inoperative position pivots the rod means out of coacting relation with the lip means for releasing the movable support for movement from the extended position to the intermediate position, and whereby the rod means is pivoted out of coacting relation with the lip means by gravity in response to movement of the movable support from the extended position to the first position.

* * * * *